US007857954B2

(12) United States Patent
Van Acker et al.

(10) Patent No.: US 7,857,954 B2
(45) Date of Patent: Dec. 28, 2010

(54) COMPACT POT TENDING MODULE FOR USE IN PLANTS FOR THE PRODUCTION OF ALUMINUM BY ELECTROLYSIS

(75) Inventors: Alain Van Acker, Orchies (FR); Stéphane David, Lomme (FR)

(73) Assignee: E.C.L. (FR)

( * ) Notice: Subject to any disclaimer, the term of this patent is extended or adjusted under 35 U.S.C. 154(b) by 737 days.

(21) Appl. No.: 11/571,127

(22) PCT Filed: Jun. 22, 2005

(86) PCT No.: PCT/FR2005/001571

§ 371 (c)(1),
(2), (4) Date: Sep. 14, 2007

(87) PCT Pub. No.: WO2006/010816

PCT Pub. Date: Feb. 2, 2006

(65) Prior Publication Data

US 2008/0075572 A1 Mar. 27, 2008

(30) Foreign Application Priority Data

Jun. 25, 2004 (FR) ..... 04 06956

(51) Int. Cl.
*C25B 9/02* (2006.01)

(52) U.S. Cl. ..... 204/297.01; 204/279; 204/286.1; 204/243.1

(58) Field of Classification Search ..... 204/279, 204/286.1, 297.01, 243.1
See application file for complete search history.

(56) References Cited

U.S. PATENT DOCUMENTS 5,435,897 A 7/1995 Zannini
2005/0211552 A1* 9/2005 Acker et al. ..... 204/247.2
2006/0049054 A1* 3/2006 Van Acker et al. ..... 205/81
2006/0060469 A1* 3/2006 Delescluse ..... 204/243.1
2010/0116653 A1* 5/2010 Van Acker ..... 204/297.01

FOREIGN PATENT DOCUMENTS

| | | | |
|---|---|---|---|
| AU | 620626 | A | 1/1990 |
| EP | 0618313 | A | 10/1994 |
| NL | 8801742 | A | 2/1990 |
| RU | 2215826 | | 11/2003 |
| SU | 935541 | | 6/1982 |

OTHER PUBLICATIONS

Office Action for Russian Application No. 2007102681, dated Jul. 2, 2009, with English translation.

* cited by examiner

*Primary Examiner*—Bruce F Bell
(74) *Attorney, Agent, or Firm*—Banner & Witcoff, Ltd.

(57) ABSTRACT

This invention relates to pot tending module intended for aluminium production plants by fused bath electrolysis. According to the invention, the turret (9) of the pot tending module (7) is equipped with a determined set of tools, in which the tool (101, 102, 103) is mounted on a telescopic arm (111, 112, 113) fixed to the turret (9) through an articulated support (121, 122, 123) that enables pendular movements of the telescopic arm with respect to a determined articulation point while preventing rotation movements of the telescopic arm about its principal axis. The telescopic arms are connected to each other through a mechanical connecting device (200) capable of maintaining the relative angular difference between the pendular movements of the telescopic arms within a determined tolerance range. The invention enables the tools to be arranged closer to each other without any risk that they will collide during use.

20 Claims, 5 Drawing Sheets

COMPACT POT TENDING MODULE FOR USE IN PLANTS FOR THE PRODUCTION OF ALUMINUM BY ELECTROLYSIS

CROSS REFERENCE TO RELATED APPLICATIONS

This application claims the benefit of priority of the filing date of Patent Cooperation Treaty patent application, Serial Number PCT/FR2005/001571, filed on Jun. 22, 2005, which is incorporated herein by reference, wherein Patent Cooperation Treaty patent application Serial Number PCT/FR2005/001571 was not published under PCT Article 21(2) in English, and also claims the benefit of priority of the filing date of French patent application, Application No. FR 0406956, filed on Jun. 25, 2004, which is incorporated herein by reference.

FIELD OF THE INVENTION

The invention relates to aluminium production by fused bath electrolysis by the Hall-Heroult process. It is related particularly to pot tending modules used in aluminium production plants.

STATE OF THE ART

Aluminium is produced industrially by fused bath electrolysis in electrolytic cells using the well-known Hall-Heroult process. Plants contain a large number of electrolytic cells arranged in line in buildings called electrolysis halls or rooms and are electrically connected in series using connecting conductors. The cells are usually arranged so as to form two or several parallel lines that are electrically connected to each other by end conductors.

The operation of an aluminium reduction plant requires work on electrolytic cells, particularly including replacement of spent anodes by new anodes, tapping of liquid metal in cells and tapping or addition of electrolyte. In order to do this work, the most modern plants are equipped with one or several pot tending assemblies including a travelling crane that can be translated above the electrolytic cells, and along series of cells, and one or several pot tending machines each comprising a trolley and a pot tending module provided with handling and working devices (often called "tools") such as shovels and hoists and that can be moved on the travelling crane. These pot tending assemblies are often called PTA (Pot Tending Assembly) or PTM (Pot Tending Machine).

Electrolytic cells are arranged to be as close to each other as possible and close to one of the sides of electrolysis halls and the narrowest possible circulation aisle is arranged close to the other side of the halls, so as to optimise the space in the electrolysis halls and to reduce investment costs. This arrangement makes it necessary for the distance between the walls of the electrolysis hall and the limits of the working area of each of the pot tending tools to be as small as possible, particularly to access electrolytic cells. This is called the "tool approach". The position of cells in the electrolysis hall and the total surface area of the halls resulting from it are very dependent on the volume occupied by pot tending machines and the possibilities of approach and movement of their tools. However, known pot tending modules occupy a large volume that makes it impossible to get close to the sides of electrolysis halls, particularly the lateral sides, and which significantly reduces their movements close to these sides. The volume of the modules may be reduced by moving the tools closer to each other. However, this solution significantly increases risks of damage to the tools during maintenance operations.

Therefore, the applicant searched for pot tending assemblies capable of avoiding these disadvantages.

SUMMARY OF THE INVENTION

An object of the invention is a pot tending module that can be used in a plant for the production of aluminium by fused bath electrolysis and including a frame that can be fixed to a trolley and a turret installed on the frame so as to be able to pivot about a vertical axis A during use and equipped with a plurality of handling and working devices, and characterised in that it comprises a determined set of tools, in that each tool in the said set is mounted on a telescopic arm fixed to the turret through an articulated support that enables pendular movements of the telescopic arm with respect to a determined articulation point while preventing rotation movements of the telescopic arm about a reference axis, called a "principal axis" associated with this telescopic arm, and in that the telescopic arms of the determined set of tools are connected to each other through a mechanical connecting device capable of maintaining the relative angular difference between the pendular movements of the telescopic arms within a determined tolerance range.

The applicant had the idea of allowing pendular movements of support means of some tools with no rotation to give these tools a positioning freedom which does not change their basic orientation, and to synchronise these pendular movements while limiting the independence of their movement (due to the said determined tolerance range) which prevents them from hitting each other, but without rigidly connecting them to each other. In particular, the said flexibility prevents shocks applied to one of the tools from directly being passed on to other tools in the set.

Thus, the pot tending module according to the invention can be compact and flexible so that close approaches can be made with tools protected against large accidental forces. The invention avoids the disadvantages of a rigid attachment on the turret, which increases the risks of damage by a false manoeuvre.

The determined assembly of tools typically includes at least one tool chosen from among crust shovels, anode handling clamps and crust breakers.

Another object of the invention is a pot tending machine including a trolley and a pot tending module like that described above.

Yet another object of the invention is a pot tending assembly for a plant for the production of aluminium by fused bath electrolysis comprising a travelling crane and at least one pot tending machine according to the invention.

Yet another object of the invention is the use of a pot tending assembly according to the invention for work on electrolytic cells intended for the production of aluminium by fused bath electrolysis.

BRIEF DESCRIPTION OF THE DRAWINGS

The invention is described in detail below with reference to the attached Figures.

DETAILED DESCRIPTION OF THE INVENTION

Figure 1:
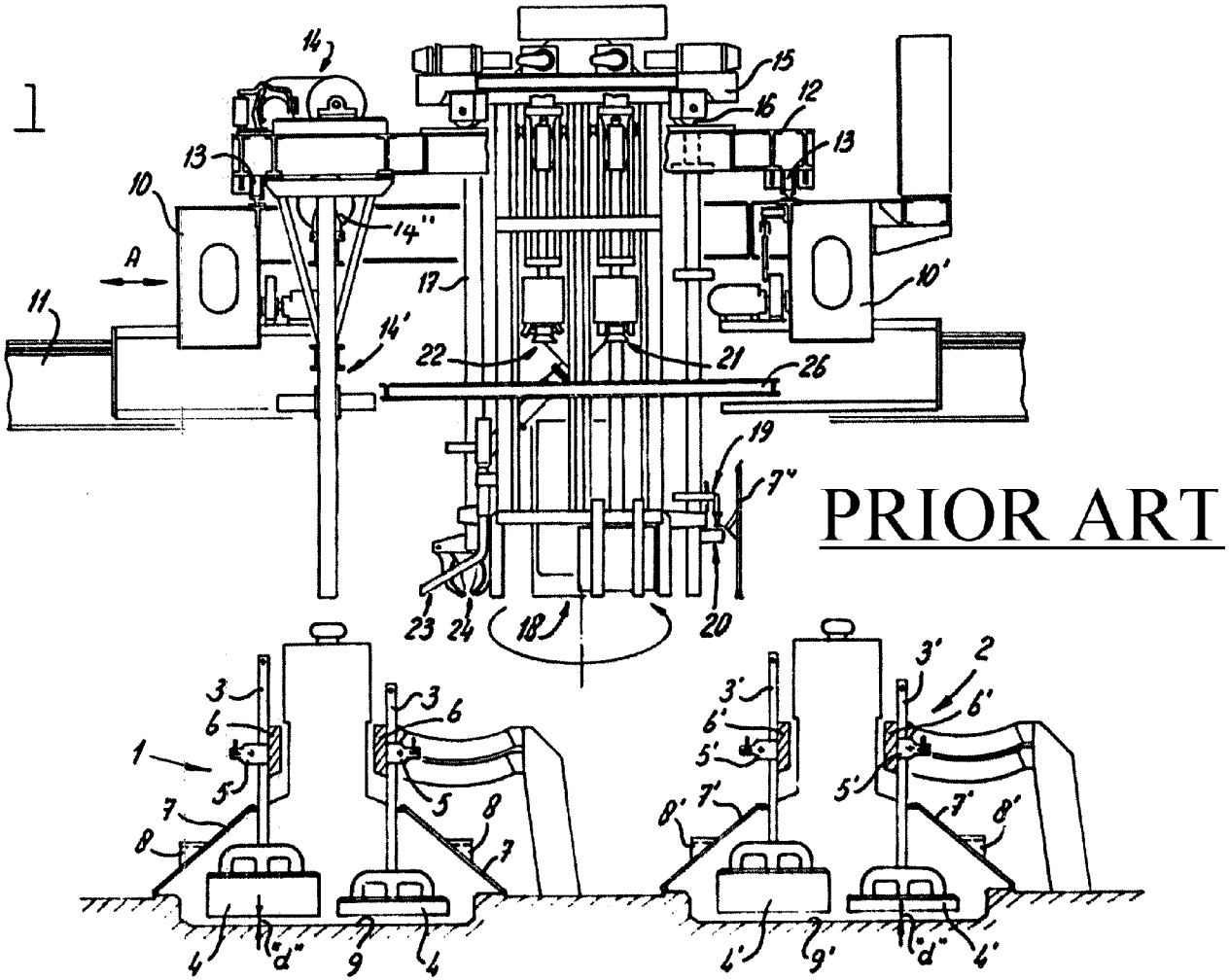
FIG. 1 illustrates a typical electrolysis hall seen in a sectional view intended for production of aluminium and including a pot tending assembly shown diagrammatically.

Aluminium reduction plants intended for aluminium production comprise a liquid aluminium production area that includes one or several electrolysis halls 1. As illustrated in FIG. 1, each electrolysis hall 1 comprises electrolytic cells 2 and at least one "pot tending assembly" or "pot tending machine" 3. The electrolytic cells 2 are normally arranged in rows or lines, each row or line typically comprising more than a hundred cells. The cells 2 are arranged so as to leave a circulation aisle 31 along the electrolysis hall 1. The cells 2 include a series of anodes 21 fitted with a metallic rod 22 to be used for attachment and electrical connection of anodes to a metallic anode frame (not illustrated).

The pot tending assembly 3 is used to carry out operations on cells 2 such as anode changes or filling feed hoppers with ground bath and electrolytic cells with $AlF_3$. They can also be used for handling various loads such as pot elements, liquid metal ladles or anodes. The invention relates particularly to pot tending assemblies that can be used for anode changes.

The pot tending assembly 3 includes a travelling crane 4 that can be translated above and along the electrolytic cells 2, and a pot tending machine 5 comprising a mobile trolley 6 that can be moved on the travelling crane 4 and a pot tending module 7 equipped with several handling and working devices 10 such as tools (shovels, wrenches, crust breakers, etc.). The travelling crane 4 rests on and travels on running tracks 30, 30' arranged parallel to each other and to the principal axis of the hall (and the line of cells). The travelling crane 4 can thus be moved along the electrolysis hall 1.

The pot tending module 7 comprises a frame 8, typically a platform, that can be fixed to a trolley 6 and a turret 9 installed on the frame 8 so that it can pivot about a vertical axis A during use. The turret 9 is usually equipped with a balcony or a control cab 19 containing controls that can be used to manoeuvre the module 7 and the said handling and working devices 10. The tools are usually all on the same side of the turret 9, namely the side below the turret during use.

Figure 2:
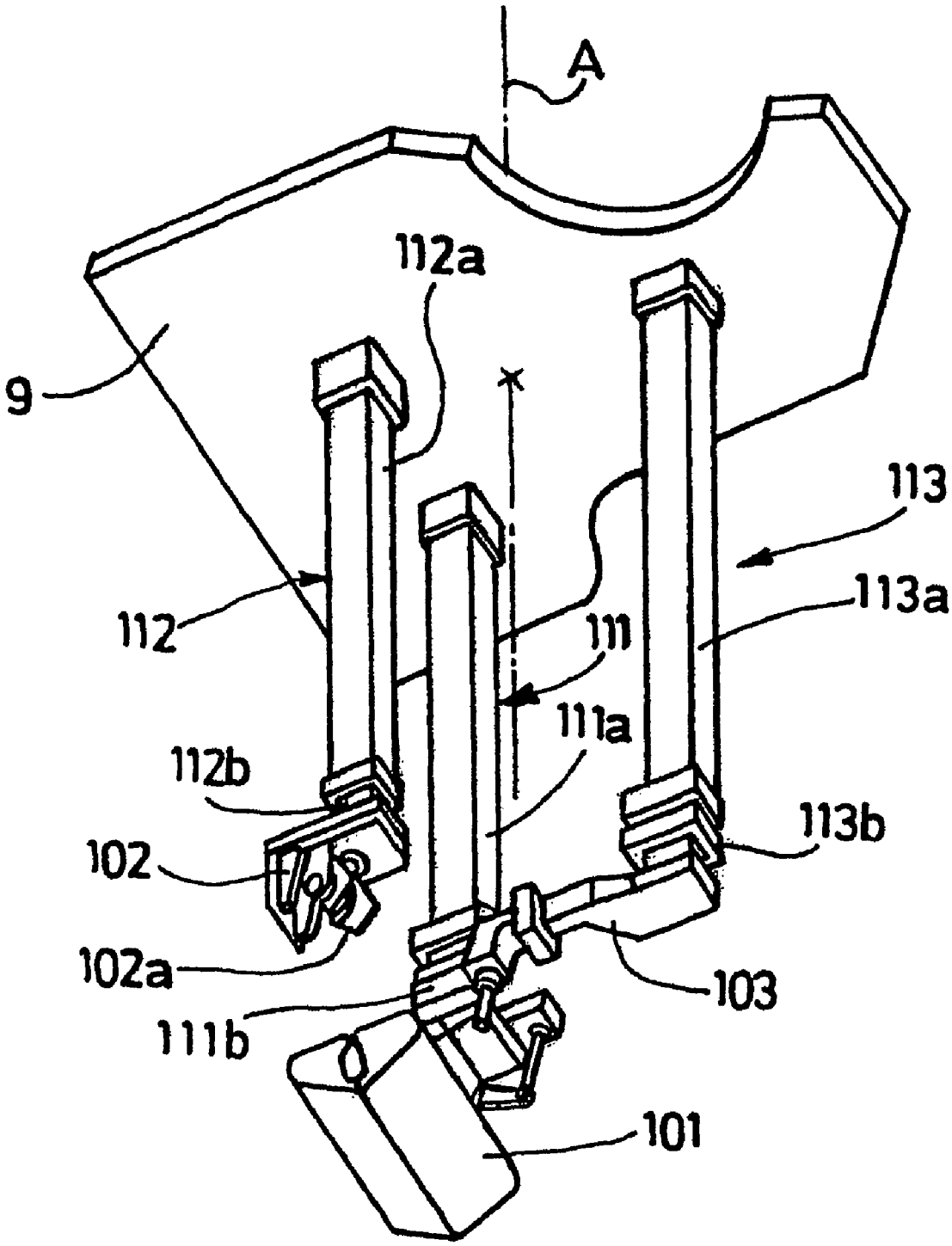
FIG. 2 illustrates a simplified and perspective view of a turret of a pot tending module fitted with standard tools.

In the example illustrated in FIG. 2, the turret 9 is equipped with a crust shovel 101 an anode handling clamp 102 and a crust breaker 103. These tools are intended for operations to change anodes in electrolytic cells. In these operations, the crust breaker 103 breaks the alumina and solidified bath crust that usually covers anodes in the cell, the crust shovel 101 is used to clear the place of the anode after the spent anode has been removed, by removal of solid materials (such as pieces of crust and alumina) that are located in it, and the anode handling clamp 102 is used to grip and manipulate anodes by their stem, particularly for the removal of spent anodes from an electrolytic cell and for placement of new anodes in the electrolytic cell. The anode handling clamp 102 may be associated with an anode connectors handling clamp 102*a*.

The turret 9 may also be equipped with other tools, such as a second anode handling clamp 104, possibly associated with a second anode connector handling clamp 104*a*, an alumina or ground bath feed device (not illustrated) including a retractable duct (not illustrated) or a hoist (not illustrated).

The turret 9 of a pot tending module according to the invention is fitted with a determined set of tools 101, 102, 103, to which one or several other tools can possibly be added. In the example embodiment illustrated in FIG. 5, the determined set of tools consists of the crust shovel 101, a first anode handling clamp 102 and a crust breaker 103.

Figure 3:
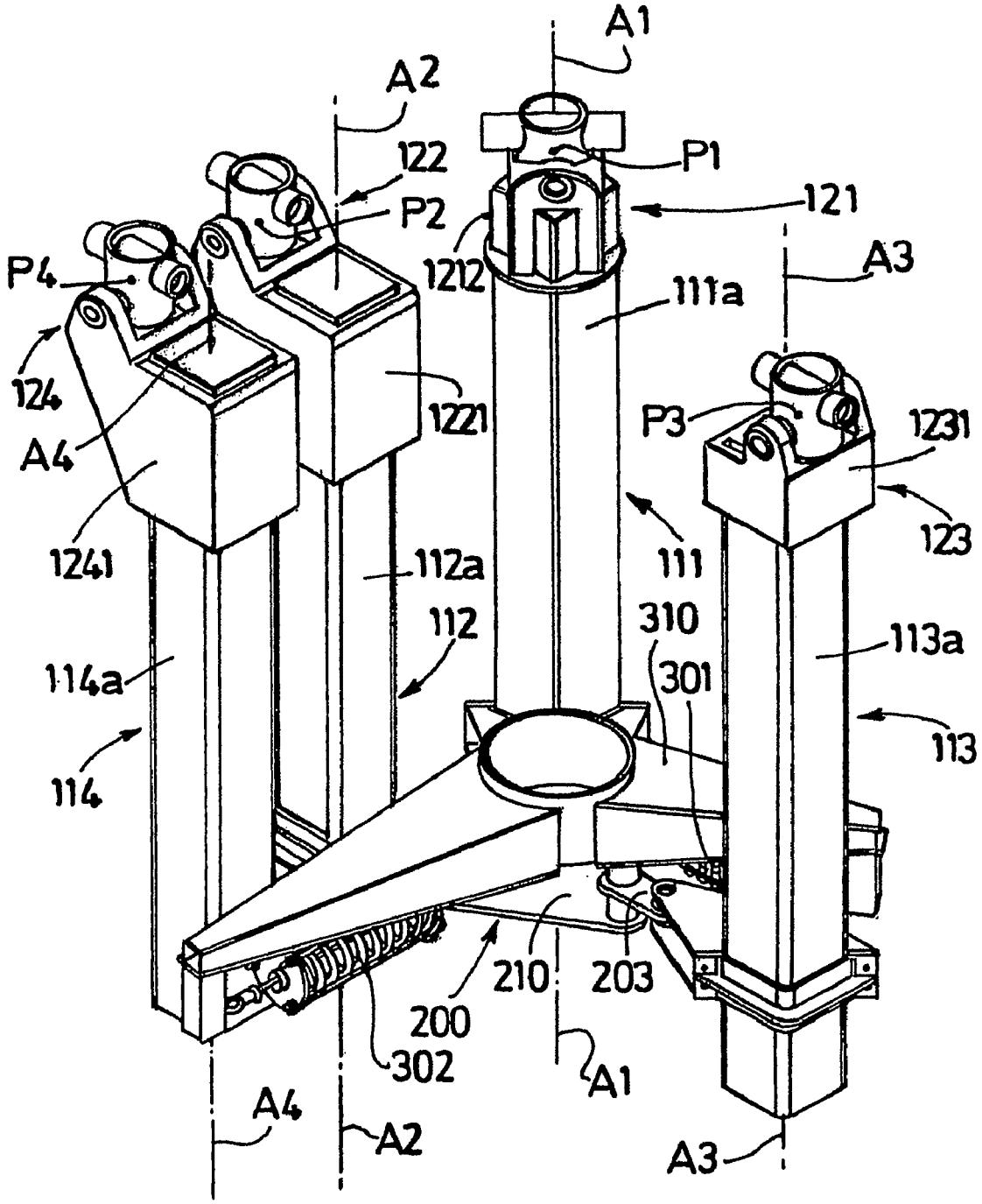
FIG. 3 is a perspective view of one embodiment of the connecting device according to the invention.

Each tool in the set is mounted on a telescopic arm 111, 112, 113 fixed to the turret by an articulated support 121, 122, 123 that enables pendular movements of the telescopic arm about a determined articulation point P1, P2, P3 while preventing rotation movements of the telescopic arm about its principal axis A1, A2, A3. The articulated supports 121, 122, 123 are typically chosen from among ball joints, universal joints and prestressed springs. Within the framework of the invention, it is advantageous to use universal joints since they are simple. Articulated supports 121, 122, 123 may be fixed to telescopic arms by any known means such as sleeves 1221, 1231, 1241 or end pieces 1212. As illustrated in FIG. 3, the articulated supports 121, 122, 123 may be offset laterally with respect to the principal axis A1, A2, A3 of the telescopic arms 111, 112, 113.

The telescopic arms 111, 112, 113 of the determined set of tools are connected to each other through a mechanical connecting device 200 that can maintain the relative angular difference between the pendular movements of the telescopic arms within a determined tolerance range. The said determined tolerance range is ±10°, in other words the absolute value of the angular difference between the principal axes of any two telescopic arms of the said set remains less than 10°.

Within the framework of the invention, the term "telescopic arm" means any device comprising at least a first member called the "principal member" 111*a*, 112*a*, 113*a*, typically a hollow shaft or an elongated frame, and a second number called a "mobile member" 111*b*, 112*b*, 113*b*, typically a rod or a hollow shaft that is free to move with respect to the first member along a determined axis, which is usually parallel to the principal axis of the first member. The first member 111*a*, 112*a*, 113*a* will be fixed to the turret. The tool is fixed to the second member 111*b*, 112*b*, 113*b*, and usually to one end of it. In the example embodiments illustrated in FIGS. 3 to 5, the telescopic arms comprise a first substantially square hollow shaft 111*a*, 112*a*, 113*a* and a second substantially square hollow shaft 111*b*, 112*b*, 113*b* free to slide inside the first hollow shaft; the principal axis of the first and second hollow shafts coincide. The telescopic arm may comprise one or several complementary intermediate members located between the first and second members and that can slide with respect to these members.

The principal axis A1, A2, A3, A4 of the telescopic arms 111, 112, 113, 114 will be substantially vertical during use and typically parallel to the first member of the telescopic arms. The principal axis of the first and second members are usually parallel to each other.

In one preferred embodiment of the invention, each telescopic arm 111, 112, 113 is fixed to the corresponding articulated support 121, 122, 123, by a first member 111*a*, 112*a*, 113*a*, typically at one end of it, and the mechanical connecting device 200 is fixed to the first member 111*a*, 112*a*, 113*a* of each telescopic arm 111, 112, 113 of the said assembly and is located below the said articulation points P1, P2, P3 during use. In the example embodiments illustrated in FIGS. 3 to 5, the first member 111*a*, 112*a*, 113*a* of each telescopic arm of the determined assembly is a hollow shaft and the mechanical connecting device 200 is fixed to these hollow shafts.

The connecting device 200 typically comprises a rigid body 210 connected directly or indirectly to each of the said telescopic arms 111, 112, 113. The rigid body 210 is typically made of steel (preferably non-magnetic steel). The device may also include connecting elements 201, 202, 203 rigidly fixed to the rigid body 210 and intended to facilitate assembly of the device and its installation onto the telescopic arms.

In one advantageous variant of the invention, the connecting device 200 is fixed to the turret, directly or indirectly, by at least one extendable connecting means 301, 302 such as an elastic means and/or an actuator. In one preferred embodiment of this variant, the connecting device 200 is advantageously fixed to a frame 310 fixed to the turret by at least one extendable connecting means 301, 302. The frame 310 is advantageously fixed to a stand 300 fixed to the turret 9.

Advantageously, the connecting device 200 comprises:

a first extendable connecting means 301 that runs along a first strain axis C1 at rest and that is connected directly or indirectly to the said frame 310, at one end, and to a first telescopic arm 111, at the other end;

a second extendable connecting means 302 that runs along a second strain axis C2 at rest, perpendicular to the first strain axis C1 at rest and is directly or indirectly connected to the said frame 310, at one end, and to a second telescopic arm 112, at the other end.

The said first and second extendable connecting means 301, 302 are typically connected to the said first and second telescopic arms 111, 112 respectively through connecting elements 201, 202.

In this embodiment, the connecting device 200 advantageously also comprises a rigid body 210 and the said connecting elements 201, 202 are also connected to the rigid body 210.

Preferably, the said rigid body 210 is also directly or indirectly connected to a third telescopic arm 113. This connection is typically made by a connecting element 203. The connection of the device with three separate telescopic arms produces a statically determinable system in which it can be guaranteed flatness of the rigid connecting points 2012, 2022, 2032 in the rigid body 210.

The said extendable connecting means 301, 302 are typically chosen from among elastic means (such as springs and prestressed springs), actuators (such as pneumatic, hydraulic or mechanical jacks) and combinations of them. The use of prestressed springs that only enable displacements starting from a predetermined excitation force threshold, can efficiently maintain the said angular difference within the said tolerance range. The use of pneumatic or hydraulic jacks provides a means of giving deliberate movements to the tools and possibly automatically controlling these movements. According to the invention, the elastic means can be used alone or in combination with an actuator (typically placed parallel to the elastic means); similarly, the actuator can be used alone or in combination with an elastic means (typically placed parallel to the actuator).

The extendable connecting means 301, 302 enable a limited movement of telescopic arms intended to keep the relative angular difference between the pendular movements of the telescopic arms within the said determined tolerance range.

Figure 4:
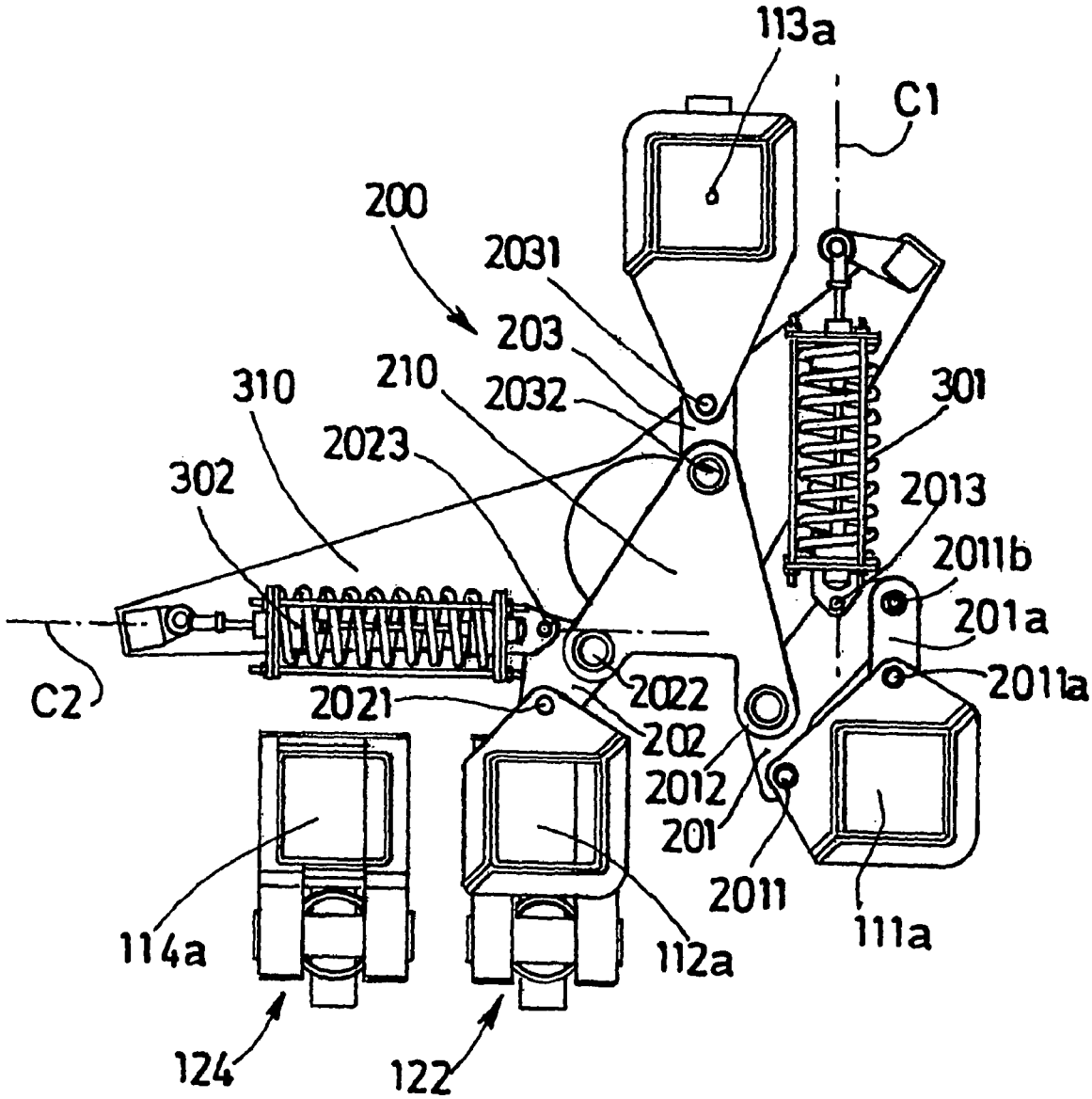
FIG. 4 is an underside view showing one embodiment of the connecting device according to the invention.
Figure 5:
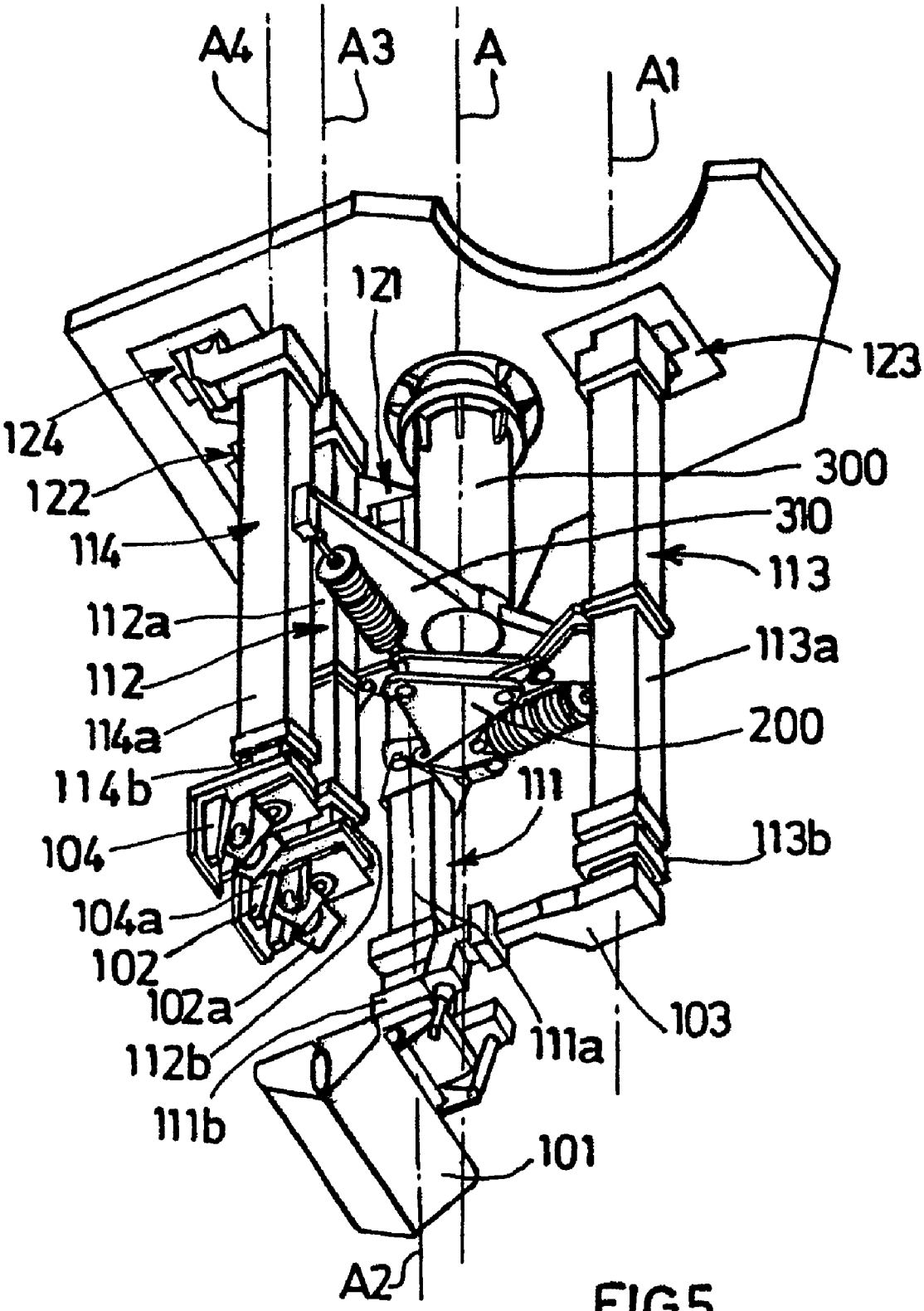
FIG. 5 is a perspective underside view illustrating the turret of a pot tending module according to one embodiment of the invention.

FIGS. 3 to 5 illustrate a preferred embodiment of the invention. In this embodiment, the device comprises a frame 310 fixed to the turret 9 through a stand 300 and a rigid body 210 connected to three telescopic arms 111, 112, 113 through connecting elements 201, 202, 203 each having a first articulated connecting point 2011, 2021, 2031 fixed to the telescopic arms 111, 112, 113 and a rigid connecting point 2012, 2022, 2032 fixed to the rigid body 210. The rigid body 210 is connected to the frame 310 by springs 301, 302 perpendicular to each other, that are fixed to the rigid body through first and second connecting elements 201, 202 each of which has a second articulated connecting point 2013, 2023. The springs may be replaced by actuators or may be combined with actuators. As illustrated in FIG. 4, the device may include one or several complementary connecting rods 201 a between the connecting elements and the telescopic arms, connected through articulated connecting points 2011*a*, 2011*b* and intended to facilitate assembly of the device on the telescopic arms.

The turret 9 may comprise at least one complementary telescopic arm 114 fixed to the turret 9 through an articulated support 124 and a connecting means between this telescopic arm and one of the other three telescopic arms 111, 112, 113 or between this telescopic arm and the connecting device 200. The said connecting means may be elastic (such as a spring) or articulated (such as a connecting rod). Preferably, the articulated support 124 enables pendular movements of the telescopic arm with respect to a determined articulation point P4 while preventing rotation movements of the telescopic arm about its principal axis A4.

The connecting device 200 can limit the amplitude of pendular movements of the telescopic arms. Thus, the tools can be arranged closer to each other without any risk that they will collide during use.

It is advantageously possible to associate the connecting device 200 with an inclination detection system fixed onto one of the telescopic arms or to a displacement detector placed on one of the elastic systems (in other words on the said springs or actuators) so that the displacements of the telescopic arms can be known and the motor power supply causing displacement of the tools can be switched off if necessary.

The pot tending module 7 according to the invention may include a walkway fixed to the said frame 310.

The invention claimed is:

1. A pot tending module for use in a plant for the production of aluminium by fused bath electrolysis comprising a first frame adapted to be fixed to a trolley, a turret installed on the first frame so as to be able to pivot about a vertical axis A during use, a plurality of telescopic arms and a plurality of handling and working devices comprising a plurality of tools, wherein each tool of the plurality of tools is mounted on at least one of the telescopic arms, and wherein the at least one of the telescopic arms is fixed to the turret through an articulated support that enables pendular movements of this telescopic arm with respect to an articulation point while preventing rotation movements of this telescopic arm about a reference axis associated with this telescopic arm, and wherein the plurality of telescopic aims are connected to each other through a mechanical connecting device capable of maintaining the relative angular difference between the pendular movements of the telescopic arms within a determined tolerance range.

2. The pot tending module of claim 1, wherein the articulated supports is chosen from the group consisting of: ball joints, universal joints and prestressed springs.

3. The pot tending module of claim 1, wherein the said determined tolerance range is ±10°.

4. The pot tending module of claim 1, wherein the at least one of the plurality of telescopic arms is fixed to an articulated support by a first member and the mechanical connecting device is fixed to the first member and is located below the said articulation points during use.

5. The pot tending module of claim 4, wherein the mechanical connecting device comprises a rigid body connected directly or indirectly to the at least one of the plurality of telescopic arms.

6. The pot tending module of claim 1, wherein the mechanical connecting device is fixed to the turret, directly or indirectly, by at least one extendable connecting means.

7. The pot tending module of claim 6, wherein the mechanical connecting device is fixed to a second frame fixed to the turret by at least one extendable connecting means.

8. The pot tending module of claim 7, wherein the second frame is fixed to a stand fixed to the turret.

9. The pot tending module of claim 6, wherein the mechanical connecting device comprises:

(a) a first extendable connecting means that runs along a first strain axis C1 at rest and is connected directly or indirectly to the second frame at one end of the first extendable connecting means, and is connected to a first one of the plurality of telescopic arms at the other end of the first extendable connecting means; and (b) a second extendable connecting means that runs along a second strain axis C2 at rest and is perpendicular to the first strain axis C1 at rest, and is directly or indirectly connected to the second frame, at one end of the second extendable connecting means, and is connected to a second one of the plurality of telescopic arms, at the other end of the second extendable connecting means.

10. The pot tending module of claim 9, wherein the first extendable connecting means is connected to the first one of the plurality of telescopic arms through a first connecting elements and the second extendable connecting means is connected to the second one of the plurality of telescopic arms through a second connecting element.

11. The pot tending module of claim 10, wherein the mechanical connecting device further comprises a rigid body, and wherein the first connecting elements and the second connecting element are connected to the rigid body.

12. The pot tending module of claim 11, wherein the rigid body is further connected, directly or indirectly, to a third one of the plurality of telescopic arms.

13. The pot tending module of claim 12, wherein the turret comprises at least one complementary telescopic arm fixed to the turret through an articulated support and a connecting means between the at least one complementary telescopic arm and one of the group consisting of the first one of the plurality of telescopic arms, the second one of the plurality of telescopic arms and the third one of the plurality of telescopic arms or between the at least one complementary telescopic arm and the mechanical connecting device.

14. The pot tending module of claim 6, wherein the at least one extendable connecting means is chosen from the group consisting of: elastic means, actuators and combinations thereof.

15. The pot tending module of claim 14, wherein the elastic means are chosen from the group consisting of: springs and prestressed springs.

16. The pot tending module of claim 14, wherein the actuators are chosen from the group consisting of: pneumatic, hydraulic or mechanical jacks.

17. The pot tending module of claim 1, wherein the plurality of tools comprises at least one tool chosen from among the group consisting of: crust shovels, anode handling clamps and crust breakers.

18. A pot tending machine comprising (a) a trolley and (b) a pot tending module comprising a first frame adapted to be fixed to a trolley, a turret installed on the first frame so as to be able to pivot about a vertical axis A during use, a plurality of telescopic arms and a plurality of handling and working devices comprising a plurality of tools, wherein each tool of the plurality of tools is mounted on at least one of the telescopic arms, and wherein the at least one of the telescopic arms is fixed to the turret through an articulated support that enables pendular movements of this telescopic arm with respect to an articulation point while preventing rotation movements of the telescopic arm about a reference axis associated with this telescopic arm, and wherein this plurality of telescopic arms are connected to each other through a mechanical connecting device capable of maintaining the relative angular difference between the pendular movements of the telescopic arms within a determined tolerance range.

19. A pot tending assembly for the production of aluminium by fused bath electrolysis comprising a travelling crane, a trolley, and a pot tending module comprising a first frame adapted to be fixed to a trolley, a turret installed on the first frame so as to be able to pivot about a vertical axis A during use, a plurality of telescopic arms and a plurality of handling and working devices comprising a plurality of tools, wherein each tool of the plurality of tools is mounted on at least one of the telescopic arms, and wherein the at least one of the telescopic arms is fixed to the turret through an articulated support that enables pendular movements of this telescopic arm with respect to an articulation point while preventing rotation movements of this telescopic arm about a reference axis associated with this telescopic arm, and wherein the plurality of telescopic arms are connected to each other through a mechanical connecting device capable of maintaining the relative angular difference between the pendular movements of the telescopic arms within a determined tolerance range.

20. A method of using a pot tending assembly according to claim 19 wherein the pot tending assembly is used to work on electrolytic cells intended for aluminium production by fused bath electrolysis.

* * * * *